US007190324B2

(12) United States Patent
Henderson

(10) Patent No.: US 7,190,324 B2
(45) Date of Patent: Mar. 13, 2007

(54) LOW-PROFILE LENS ANTENNA

(75) Inventor: Robert I Henderson, Chelmsford (GB)

(73) Assignee: Bae Systems plc, London (GB)

( * ) Notice: Subject to any disclaimer, the term of this patent is extended or adjusted under 35 U.S.C. 154(b) by 3 days.

(21) Appl. No.: 10/494,320

(22) PCT Filed: Mar. 30, 2004

(86) PCT No.: PCT/GB2004/001347

§ 371 (c)(1),
(2), (4) Date: Apr. 30, 2004

(87) PCT Pub. No.: WO2004/088793

PCT Pub. Date: Oct. 14, 2004

(65) Prior Publication Data

US 2004/0263419 A1 Dec. 30, 2004

(30) Foreign Application Priority Data

Mar. 31, 2003 (EP) ..... 03252032
Mar. 31, 2003 (GB) ..... 0307413.5

(51) Int. Cl.
*H01Q 15/02* (2006.01)
*H01Q 15/24* (2006.01)
*H01Q 13/00* (2006.01)
*H01Q 19/06* (2006.01)

(52) U.S. Cl. ..... 343/909; 343/783; 343/753

(58) Field of Classification Search ..... 343/783, 343/909, 753, 720, 846, 781 CA, 911 R, 343/911 L, 848, 705, 700 MS
See application file for complete search history.

(56) References Cited

U.S. PATENT DOCUMENTS 2,887,684 A * 5/1959 Dexter et al. ..... 343/781 R
4,447,811 A 5/1984 Hamid ..... 343/783
4,488,156 A 12/1984 DuFort et al. ..... 343/754
5,706,017 A 1/1998 Büttgenbach ..... 343/753

(Continued)

FOREIGN PATENT DOCUMENTS

DE 197 14 578 A 11/1998

(Continued)

OTHER PUBLICATIONS

Fernandes et al; "Constant Flux Illumination of Square Cells for Millimeter-Wave Wireless Communications"; IEEE Transactions on Microwave Theory and Techniques, IEEE Inc. New York, US, vol. 49, No. 11, Nov. 2001, pp. 2137-2141, XP001110333.

(Continued)

*Primary Examiner*—Don Wong
*Assistant Examiner*—Marie Antoinette Cabucos
(74) *Attorney, Agent, or Firm*—Nixon & Vanderhye P.C.

(57) ABSTRACT

This invention relates to a low-profile lens antenna. In particular, this invention relates to a low-profile lens antenna for use in a depression in a surface, e.g. a concavity in the ground. A low-profile lens antenna is provided that comprises a feed and a lens, wherein the lens is shaped to produce a radiation pattern that shows a general increase in power from 0° to 90° from the central axis of the antenna when illuminated with radiation from the feed.

21 Claims, 1 Drawing Sheet

U.S. PATENT DOCUMENTS

| | | | | |
|---|---|---|---|---|
| 5,764,199 | A * | 6/1998 | Ricardi | 343/911 R |
| 6,266,028 | B1 * | 7/2001 | Schmidt et al. | 343/909 |
| 6,310,587 | B1 | 10/2001 | Villino et al. | 343/911 R |
| 6,344,829 | B1 * | 2/2002 | Lee | 343/753 |
| 6,362,795 | B2 * | 3/2002 | Ishikawa et al. | 343/753 |
| 2002/0149520 | A1 * | 10/2002 | Laubner et al. | 343/700 MS |

FOREIGN PATENT DOCUMENTS

| | | | | |
|---|---|---|---|---|
| EP | 1249892 | A2 | 10/2002 | 343/790 |

OTHER PUBLICATIONS

Ying et al; "Improvements of Dipole, Helix, Spiral, Microstrip Patch and Aperture Antennas With Ground Planes by Using Corrugated Soft Surfaces"; IEE Proceedings: Microwaves, Antennas and Propagation, IEE, Stevenage, Herts, GB, vol. 43, No. 3, Jun. 13, 1996, pp. 244-248, XP006006561.

C. Fernandes, "Shaped Dielectric Lenses for Wireless Millimeter-Wave Communications" *IEEE Antennas and Propagation Magazine*, vol. 41, No. 5, Oct. 1999, pp. 141-149.

* cited by examiner

LOW-PROFILE LENS ANTENNA

This application is the U.S. national phase of international application PCT/GB2004/001347, filed in English on 30 Mar. 2004, which designated the U.S. PCT/GB2004/001347 claims priority to GB Application No. 0307413.5, filed 31 Mar. 2003 and EP Application No. 03252032.2 filed 31 Mar. 2003. The entire contents of these applications are incorporated herein by reference.

This invention relates to a low-profile lens antenna. In particular, this invention relates to a low-profile lens antenna for use in a depression in a surface, e.g. a concavity in the ground.

An example of an application of the present invention, which is given for the purpose of illustration only, is an antenna for use on the flight deck of an aircraft carrier. Personnel on a flight deck must be provided with a communication system and one way of achieving this is with a radio link operating at 60 GHz via a network of cellular antennas. For communication at these microwave frequencies, a shaped-beam antenna is required to illuminate an area of flight deck with uniform signal strength but not to illuminate strongly the airspace above the carrier. The easiest way of achieving this is by using an antenna that sits proud of the flight deck and so can have a radiation pattern that is strongly biased to emit sideways therefrom.

However, such antennas are obstructive and present an obstacle for aircraft moving around the flight deck. It is clearly preferable to leave the flight deck as flat as possible. Ideally, antennas would be set into the flight deck such that aircraft can pass safely over them. However, merely relocating a standard antenna within a recess in a flight deck produces a radiation pattern that is strongly peaked above the carrier with little or no radiation emitted around the flight deck. This problem can be addressed by the use of a lens, but standard lenses have heights of several centimetres or more, thus making them unsuitable for use in a carrier flight deck environment.

Against this background, and from a first aspect, the present invention resides in a low-profile lens antenna comprising a feed and a lens, wherein the feed is shaped to produce a radiation pattern that shows a general increase in power from 0° to 90° from the central axis of the lens antenna when illuminated with radiation from the feed. Conveniently, providing a lens shaped in this way ensures that the radiation transmitted from the lens has a fairly uniform power level at any fixed height at any distance from the lens and in all directions in azimuth. When used in an aircraft-carrier flight deck environment, this ensures that the radiation pattern provides enhanced coverage across the flight deck at the expense of unwanted radiation in an upward direction. In this way, communication is difficult to intercept any distance above the aircraft carrier but is adequate for communicating in the noisy environment of a flight deck. Moreover, use of the lens allows the bulk of the antenna to be sited in a recess within a flight deck with only a small portion of the lens protruding above the level of the flight deck. Thus, the antenna is not obtrusive and does not obstruct traffic from moving around the flight deck. Optionally, the lens may be shaped to produce a $\sec^2\theta$ radiation pattern when illuminated with radiation from the feed, where $\theta$ is the angle from the central axis of the lens.

Preferably, the feed is arranged to illuminate the lens with a uniform feed radiation pattern. This is beneficial in terms of providing a uniform radiation pattern from the antenna.

Optionally, the feed and the lens are arranged such that the feed terminates in a cavity to face an inner surface of the lens. Preferably, the feed has a circular cross-section and terminates in a part-spherical cavity, whereby the inner surface of the lens defines the part-spherical cavity. This is a particularly convenient way of shaping the lens and configuring the antenna to provide the desired radiation pattern.

Optionally, a portion of the feed having circular cross-section is provided with a circular polariser, thereby allowing the antenna to emit circularly polarised radiation.

In a preferred embodiment, the lens presents a convex outer profile. This is beneficial as a convex profile helps to produce the desired radiation pattern and is also beneficial as a convex protrusion from a flight deck or the like helps the passage of traffic thereover.

Optionally, the lens comprises at least one blooming layer. Preferably the relative permittivity of the lens is substantially 1.5 and the relative permittivity of the blooming layer is substantially 1.25. Blooming layers have been found useful in achieving the desired radiation pattern.

Optionally, the feed is a waveguide of a circular cross-section that is at least partially filled with a plug having an enlarged head of circular cross section. Such an arrangement helps ensure illumination of the lens with a uniform feed radiation pattern. Preferably the diameter of the body is substantially 2.8 mm and the diameter of the head is substantially 3.8 mm.

Preferably, the feed is located in a ground plane. Optionally, the feed and ground plane are circular in cross section and are concentrically arranged, and the ground plane is concentrically corrugated. This helps maintain the purity of the circular polarisation. In a preferred embodiment the corrugations comprise a plurality of circular grooves. Optionally, the grooves have dimensions to correspond substantially to the operating wavelength of the antenna. Conveniently, the grooves are rectangular in cross section and are substantially 1.5 mm deep, substantially 1.0 mm wide and spaced apart by substantially 1.5 mm.

The present invention also extends to a low-profile lens antenna located in a recess, and to a low-profile antenna located on the flight deck of an aircraft carrier.

The invention will now be described, by way of example only, by reference to the accompanying drawings in which.

Figure 1:
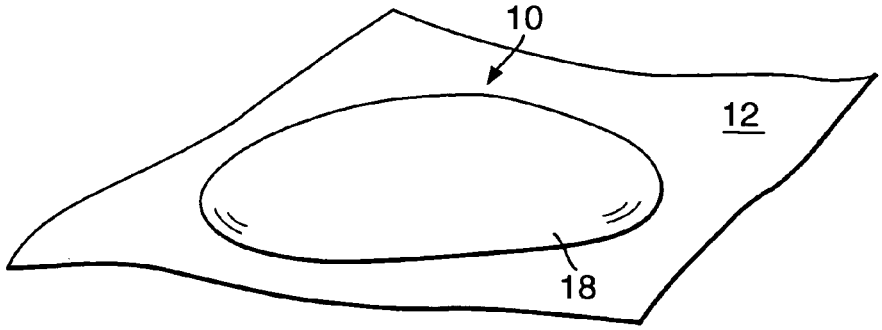
FIG. 1 is a perspective view of a low profile lens antenna according to an embodiment of the present invention.
Figure 2:
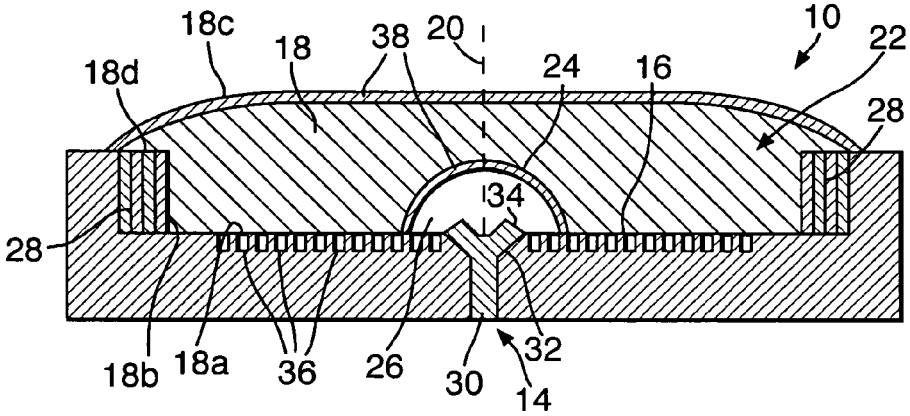
FIG. 2 is a cross-sectional view of the low-profile lens antenna of FIG. 1.

A low profile lens antenna 10 for use in a 60 GHz communication system is shown in FIGS. 1 and 2. The antenna 10 is located on an aircraft carrier flight deck 12 and comprises a feed 14 that terminates at a ground plane 16 to face a lens 18. The antenna 10 is cylindrically symmetric about a central axis 20 and the feed 14, ground plane 16 and lens 18 are arranged concentrically. The ground plane 16 is formed by the base of a recess 22 provided in the flight deck 12, there being a further recess provided in the base to house the feed 14.

The lens 18 is shaped and sized so as to fit largely within the recess 22. The lower surface 18*a* of the lens 18 rests against the base of the recess 22 around its outer portion. In this way, the base of the recess 22 provides support for the lens 18 when it is trodden on or when an aircraft wheel passes over the lens 18. The lower surface 18*a* of the lens 18 is provided with a hemispherical depression 24 at its centre that sits directly above the feed 14 to define a hemispherical cavity 26 of radius 10 mm therebetween. The diameter across the sides of the lens 18 is slightly smaller than the diameter of the recess 22 so as to leave a small ring shaped gap therebetween. This gap is filled by an annular-shaped load material 28. The sides of the lens 18*b* are stepped such that the top 18*c* of the lens 18 caps the entire recess 22 and has a small peripheral flange 18*d* that abuts against the outer surface of the flight deck 12. The top surface 18 of the lens 18 has a shallow dome-shape to present a raised profile of only 8 mm and hence is far smaller than the antennas hitherto available. The diameter of the lens 18 is 100 mm. As the top surface 18*c* of the lens 18 is exposed on the flight deck 12 of an aircraft carrier, it must be rugged and hard wearing as much traffic may pass over it.

The feed 14 is generally a cylindrical waveguide and comprises a body of 2.8 mm diameter. The feed is filled with a PEEK (poly-ether-ether-ketone) plug 30 with a dielectric constant (relative permittivity) of 3.5. The generally cylindrical waveguide terminates with a chamfered face 32 at an angle of 30° away from the surface of the ground plane 16 to extend to a diameter of 3.8 mm. The plug 30 extends from the waveguide to form a crater-like protrusion 34 with a height of 1.9 mm and a radius of 1.9 mm. This particular dielectric loading of the waveguide aperture produces a roughly flat-topped radiation pattern from 0°–60°. The input to the feed 14 can be via a simple circular-to-rectangular waveguide taper, to which a coaxial transmission line can be attached.

In a preferred embodiment, the waveguide of circular cross-section includes a device (i.e. a polariser) to produce circularly-polarised radiation from the feed 14, and thus from the antenna 10. Many well-known devices can be used, for example incorporating flats on either side of the circular waveguide that are oriented at 45° to the incident linear polarisation, or rows of pins inserted into opposite sides of the waveguide also at 45° to the plane of linear polarisation. The polariser could also be a separate device connected between the circular waveguide of the antenna 10 and a rectangular-to-circular transition.

To improve the circular polarisation of the radiation pattern produced by the feed 14, the ground plane 16 is corrugated as best seen in FIG. 2. The corrugations 36 are 1.5 mm deep and 1.0 mm wide with a spacing of 1.5 mm deep and form a set of concentric rings around the feed 14. These dimensions correspond to around a quarter of a wavelength of the microwave radiation the antenna emits and receives (values in the range of a quarter to a third of a wavelength have been found to be optimal).

The radiation pattern formed by the feed 14 and corrugated ground plane 16 propagates across the hemispherical cavity 26 to illuminate the lens 18 with a uniform radiation pattern. The radiation enters the lens 18 without refraction. The lens 18 is made from a syntactic foam composite material and has a dielectric constant of 1.5. A blooming layer 38 with a dielectric constant of 1.25 and a thickness of 1 mm is provided both on the outer surface of the lens 18 and the inner surface 24 that defines the hemispherical cavity 26. To reduce scattering from the edges 18*b* of the lens 18 (and thus reduce radiation pattern lobes), the load material 28 is provided to fill the space between the lens sides 18*b* and the sides of the recess 22. The load material 28 may be any microwave absorber, such as carbon-impregnated foams.

Figure 3:
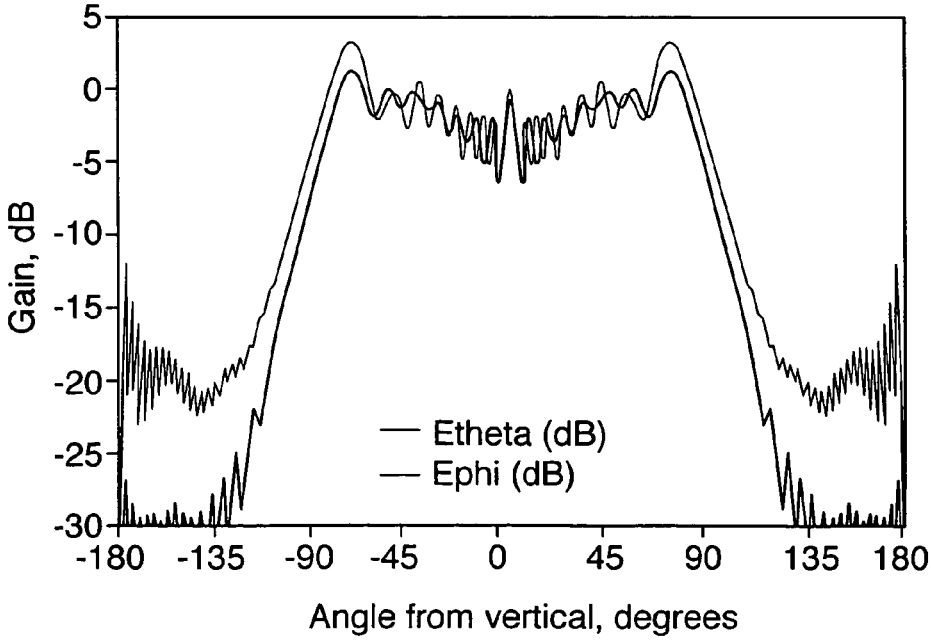
FIG. 3 is an example of a typical radiation pattern emitted by a low-profile lens antenna according to the present invention.

The shape of the top surface 18*c* of the lens 18 is determined by the exact shape of radiation pattern required. Refraction at the curved top surface 18*c* of the lens 18 broadens the radiation pattern, increasing the width of the beam from 120° to 180°. Well-known mathematical methods based on geometrical optics can be used to calculate the required profile. In the embodiment shown, the lens shape has been designed to meet a required power pattern that approximates to a $\sec^2\theta$ distribution out to at least 80° from the vertical. The radiation pattern obtained with this antenna 10 is shown in FIG. 3 for two orthogonal directions along the flight deck 12 as measured as a function of angle from the vertical (i.e. the central axis 20 of the antenna). As can be seen, a fairly uniform radiation pattern is obtained from the vertical direction above the carrier all the way to the horizontal direction across the flight deck 12. This is in contrast to previous antennas, whose radiation pattern has a pronounced peak at the vertical that falls away to diminished intensities of angles corresponding to transmission across the flight deck 12.

It will be readily apparent to those skilled in the art that variations to the above described embodiment are possible without departing from the scope of the invention defined in the appended claims.

For example, PEEK is but only a preferred choice of dielectric for use as a plug 30 in the waveguide. Materials of different dielectric constant can be used instead for both the waveguide and the lens. Clearly, low-loss dielectrics are advantageous in order to mitigate the problem of signal attenuation.

The invention claimed is:

1. A low-profile lens antenna for providing a radiation pattern above an upper surface of a substrate, said antenna comprising:

a feed; and a lens, wherein at least a portion of said lens is located in a recess below a surface of said substrate, wherein the lens is shaped to produce a radiation pattern that shows a general increase in power from 0° to 90° from the central axis of the antenna when illuminated with radiation from the feed.

2. A low-profile lens antenna according to claim 1, wherein the lens is shaped to produce a $\sec^2\theta$ radiation pattern when illuminated with radiation from the feed.

3. A low-profile lens antenna according to claim 1, wherein the feed is arranged to illuminate the lens with a uniform feed radiation pattern.

4. A low-profile lens antenna according to claim 1, wherein the feed and the lens are arranged such that the feed terminates at a cavity to face an inner surface of the lens.

5. A low-profile lens antenna according to claim 4, wherein the feed has a circular cross-section and terminates in a part-spherical cavity, whereby the inner surface of the lens defines the part-spherical cavity.

6. A low-profile lens antenna according to claim 5, wherein a portion of the feed having circular cross-section is provided with a circular polariser.

7. A low-profile lens antenna according to claim 1, wherein the lens presents a generally convex outer profile.

8. A low-profile lens antenna according to claim 1, wherein the lens comprises at least one blooming layer.

9. A low-profile lens antenna according to claim 8, wherein the relative permittivity of the lens is substantially 1.5 and the relative permittivity of the blooming layer is substantially 1.25.

10. A low-profile lens antenna according to claim 1, wherein the feed is a waveguide of circular cross-section, that is at least partially filled with a plug having an enlarged head of circular cross section.

11. A low-profile lens antenna according to claim 10, wherein the diameter of the waveguide is substantially 2.8 mm and the diameter of the head is substantially 3.8 mm.

12. A low-profile lens antenna according to claim 1, wherein the feed is located in a ground plane.

13. A low-profile lens antenna according to claim 12, wherein the feed and ground plane are circular in cross section and are concentrically arranged, and whereby the ground plane is concentrically corrugated.

14. A low-profile lens antenna according to claim 13, wherein the corrugations comprise a plurality of circular grooves.

15. A low-profile lens antenna according to claim 14, wherein the grooves have dimensions to correspond substantially to one quarter of the operating wavelength of the antenna.

16. A low-profile lens antenna according to claim 15, wherein the grooves are rectangular in cross section and are substantially 1.5 mm deep, substantially 1.0 mm wide and spaced apart by substantially 1.5 mm.

17. A low-profile lens antenna according to claim 1, wherein the antenna is located in a recess.

18. A low-profile lens antenna according to claim 1, wherein the antenna is located on a flight deck of an aircraft carrier.

19. A low-profile lens antenna comprising:

a feed; and a lens, wherein the lens is shaped to produce a $\sec^2\theta$ radiation pattern that shows a general increase in power from 0° to 90° from the central axis of the antenna when illuminated with radiation from the feed.

20. A low-profile lens antenna comprising:

a feed; and a lens comprising at least one blooming layer, wherein the lens is shaped to produce a radiation pattern that shows a general increase in power from 0° to 90° from the central axis of the antenna when illuminated with radiation from the feed, wherein the relative permittivity of the lens is substantially 1.5 and the relative permittivity of the at least one blooming layer is substantially 1.25.

21. A low-profile lens antenna according to claim 1, wherein lens has a curved radiating surface and the ratio of the diameter of the curved radiating surface of the lens and the extent the lens extends above the surface is at least 10:1.

* * * * *